US005418989A

United States Patent [19]

Roe

[11] Patent Number: 5,418,989

[45] Date of Patent: May 30, 1995

[54] MATTRESS INNERSPRING USING FORMED WIRE ELEMENTS

[75] Inventor: Richard C. Roe, Palatine, Ill.

[73] Assignee: Serta, Inc., Des Plaines, Ill.

[21] Appl. No.: 182,479

[22] Filed: Jan. 13, 1994

[51] Int. Cl.[6] ..... A47C 23/00

[52] U.S. Cl. ..... 5/476; 5/247; 5/255; 5/268; 267/93

[58] Field of Search ..... 5/247, 255, 260, 267, 5/268, 275, 276, 277, 464, 474, 476; 267/93, 95, 97, 103, 105

[56] References Cited

U.S. PATENT DOCUMENTS

| | | | |
|---|---|---|---|
| 2,610,333 | 3/1949 | Piliero | 5/351 |
| 3,561,021 | 2/1971 | Slominski | 5/247 |
| 4,052,760 | 10/1977 | Golembeck et al. | 5/474 X |
| 4,207,634 | 6/1980 | Kitchen et al. | 5/255 |
| 4,238,861 | 12/1980 | Mizelle | 5/255 X |
| 4,251,892 | 2/1981 | Hancock | 5/476 X |
| 4,662,011 | 5/1987 | Duvivier | 5/476 |
| 4,770,397 | 9/1988 | Schulz, Jr. | 5/247 X |
| 4,813,656 | 3/1989 | Ramsey | 5/247 X |
| 4,932,535 | 6/1990 | Dabney | 5/476 X |

*Primary Examiner*—Michael F. Trettel
*Attorney, Agent, or Firm*—Gardner, Carton & Douglas

[57] ABSTRACT

Disclosed is an improved innerspring unit for a mattress using a plurality of formed wire elements for support. Enhanced lateral and longitudinal stability of the improved innerspring is provided by one or more stabilizing features including dual formed wire elements, complimentary recesses to secure the intersection of longitudinal and lateral wires and formed wire elements disposed on the edges of the unit which are formed of the same wires which extend longitudinally and laterally across the unit. A variety of different formed wire elements is disclosed, each of which provide different support characteristics. By varying the type, number and location of the different formed wire elements, a particular support profile may be provided which may correspond, for example, to the weight contour of a prone human body.

21 Claims, 4 Drawing Sheets

MATTRESS INNERSPRING USING FORMED WIRE ELEMENTS

FIELD OF THE INVENTION

The present invention relates generally to innerspring units, and relates more particularly to an improved innerspring unit for a mattress using formed wire elements.

BACKGROUND OF THE INVENTION

Conventional innerspring units for a mattress are typically constructed of a great number of identical and substantially helical-shaped coils that resemble springs, which are uniformly disposed in rows and columns over the entire area of the innerspring unit. The level of support and comfort provided by a mattress, often referred to as "firmness," is a function of both the filling and padding materials on the top and bottom of the innerspring unit and the performance characteristics of the coils. Since the identical coils of a conventional innerspring are uniformly disposed over the entire area of the innerspring, the resulting mattress will have substantially constant support characteristics over the entire area of the mattress. In other words, the level of support provided at one location will be the same as the level of support provided at another location.

The edge support provided by a conventional mattress designed with an innerspring formed from coils is usually inadequate due to the inherent physical characteristics of a coil. A coil is symmetric about its central axis and therefore must be inset to avoid extending beyond the edge of the innerspring unit. As a result, support at the edge of the innerspring is provided merely by the edge of the coil, which is significantly less firm and has a tendency to "tip" or deflect sideways when pressure is applied.

In many cases a constant level of support is not a desirable feature of a mattress. For example, the force applied to a mattress by a prone human body varies depending upon the particular portion of the body which is considered. A human torso will usually exert considerably greater force on the mattress than a leg, foot, or head. A conventional mattress design will, however, provide the same support for all areas of the body, which in some cases may lead to discomfort. Furthermore, most king- and queen-sized mattresses are designed to accommodate two individuals in a prone position. Since one individual may have a dramatically different physical profile and weight characteristics than the other individual, a conventional mattress may provide one individual with a dramatically different, and likely undesirable, comfort level than the other individual.

Conventional mattress innerspring units are designed with a great number of coils. For example, an innerspring for a king-sized mattress may use more than 1000 identical coils for support. Such a design can be undesirably heavy, as well as extraordinarily complicated, expensive and difficult to manufacture and assemble. Due to the great number of coils needed to provide adequate support for a conventional mattress, it is impractical to even consider varying the type or location of coils disposed throughout the innerspring. Moreover, in order to efficiently and cost-effectively manufacture a conventional innerspring, high speed automated equipment is required which repetitively selects, positions and affixes the identical coils uniformly throughout the area between the wire grids.

U.S. Pat. No. 3,561,021 to Slominski (Feb. 9, 1971) discloses an innerspring design that uses formed wires for support. Slominski is directed to a design fabricated by assembling a plurality of identical elongated modules in a side-by-side relation to the desired width of the unit. It is apparent that the Slominski design was not met with success, likely because of its inability to provide adequate lateral stability. Furthermore, Slominski teaches fabrication from identical formed wire elements, which results in a mattress, similar to conventional coil mattresses, that provides constant support throughout the entire area of the mattress.

SUMMARY OF THE INVENTION

It is an object of the present invention to provide an improved innerspring design for a mattress using a plurality of formed wire elements. In this regard, it is a related object of the present invention to provide such an innerspring design which will greatly reduce the weight, cost and complexity of a conventional innerspring for a mattress. It is another related object of the present invention to provide such an improved innerspring design that provides substantially greater edge support than a conventional innerspring for a mattress.

It is another object of the present invention to provide such an improved innerspring design that allows the level of support to be advantageously varied throughout the area of a mattress. It is a related object of the present invention to provide such an improved innerspring design that may be advantageously fabricated to generally follow the weight contour of a prone human body. It is another related object of the present invention to provide such an improved innerspring design that advantageously provides support that generally follows the weight contour of two or more different prone human bodies.

It is another object of the present invention to provide such an improved innerspring design that provides enhanced lateral and longitudinal stability.

It is another object of the present invention to provide such an improved innerspring design that may be efficiently and cost-effectively manufactured.

The above and additional objects are realized in the present invention which provides an improved innerspring design for a mattress using a plurality of formed wire elements for support. Substantial stability is achieved by one or more of several stabilizing features of the invention. An important aspect of the invention is that a variety of different formed wire elements may be used in order to vary the response of the resulting mattress to conform to a particular desired support profile.

BRIEF DESCRIPTION OF THE DRAWINGS

Other objects and advantages of the invention will be apparent from the following detailed description and the accompanying drawings, in which.

DETAILED DESCRIPTION OF THE INVENTION

Figure 1:
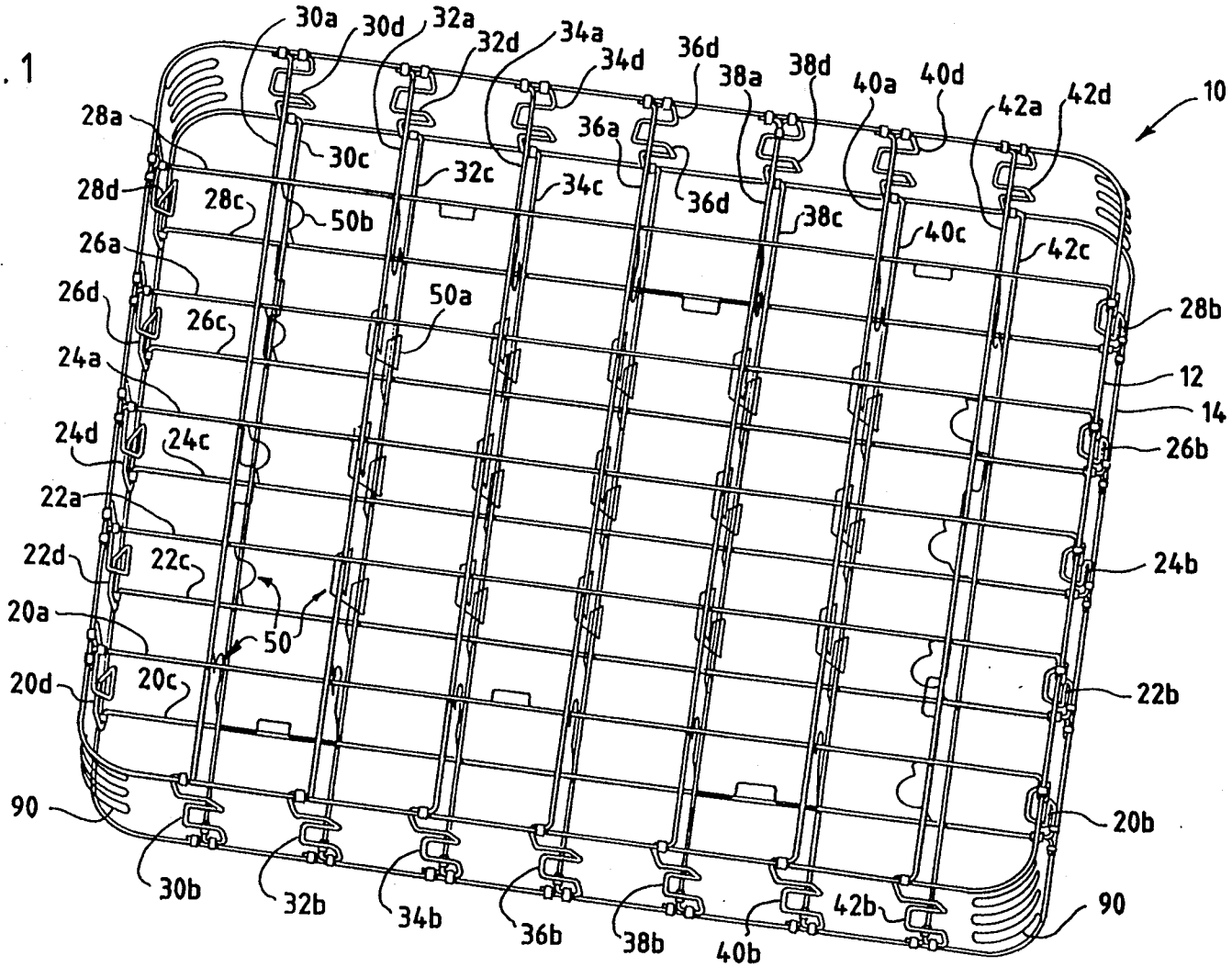
FIG. 1 is a perspective view of an innerspring unit according to one embodiment of the invention.

While the invention is susceptible to various modifications and alternative forms, certain preferred embodiments are shown by way or example in the drawings and will herein be described in detail. It should be understood. However, that it is not intended to limit the invention to the particular forms described, but to the contrary, the intention is to cover all modifications, equivalents, and alternatives falling within the spirit and scope of the invention as defined by the appended claims.

Turning now to the drawings, FIG. 1 illustrates an innerspring unit 10 according to one embodiment of the invention. The boundaries of the innerspring unit 10 are generally defined by an upper border wire 12 and a lower border wire 14. The border wires 12 and 14 are preferably formed of high carbon wire, for example, 6 to 11 gauge high carbon wire, which is relatively resilient and resistant to deformation. The border wires 12 and 14 are preferably formed from a single strand of high carbon wire which is worked to retain a bend at each of the four corners and the two ends of the wire are joined together by welding, interlocking, clipping or other means for securely affixing the two ends of the wire.

According to the embodiment of the invention illustrated in FIG. 1, there is provided a plurality of upper longitudinal formed wires 20*a*, 22*a*, 24*a*, 26*a* and 28*a*, a corresponding plurality of lower longitudinal formed wires 20*c*, 22*c*, 24*c*, 26*c* and 28*c*, a plurality of upper lateral formed wires 30*a*, 32*a*, 34*a*, 36*a*, 38*a*, 40*a* and 42*a* and a corresponding plurality of lower lateral formed wires 30*c*, 32*c*, 34*c*, 36*c*, 38*c*, 40*c* and 42*c*. As can be seen, the upper longitudinal formed wires 20*a*–28*a* intersect with the upper lateral foraged wires 30*a*–42*a* to form an upper support grid for the innerspring unit 10. Similarly, the lower longitudinal formed wires 20*c*–28*c* intersect with the lower lateral formed wires 30*c*–42*c* to form a lower support grid for the innerspring unit 10. The longitudinal and lateral formed wires, which are preferably formed of high carbon wire, will preferably each include a formed wire spring segment disposed at the edge of the innerspring unit. For example, upper longitudinal formed wire 22*a* includes a formed wire segment that extends along the top for the entire length of the innerspring unit and includes, at one end a formed wire spring segment 22*b* which is disposed directly on the edge of the innerspring unit 10 between the upper 12 and lower 14 border wires. The corresponding lower longitudinal formed wire 22*c* is complimentary and includes a formed wire segment that extends along the bottom for the entire length of the innerspring unit 10 and also includes, at the other end a formed wire spring segment 22*d* which is disposed directly on the other edge of the innerspring unit 10 between the upper 12 and lower 14 border wires. The ends of the complimentary upper and lower longitudinal wires, for example 22*a* and 22*c*, will preferably be securely affixed to each other and the upper 12 and lower 14 border wires by welding, interlocking, clipping or other means. Alternatively, both complimentary upper and lower longitudinal wires, including the two corresponding formed wire spring segments disposed on the edges, may be formed from a single piece of high carbon formed wire, the ends of which are similarly securely affixed to each other. As illustrated, the upper 30*a*–42*a* and lower 30*c*–42*c* lateral formed wire elements, are similarly disposed (but run laterally) and also include formed wire spring segments 30*b*–42*b* and 30*d*–42*d* at the edges of the innerspring unit 10.

Figure 2:
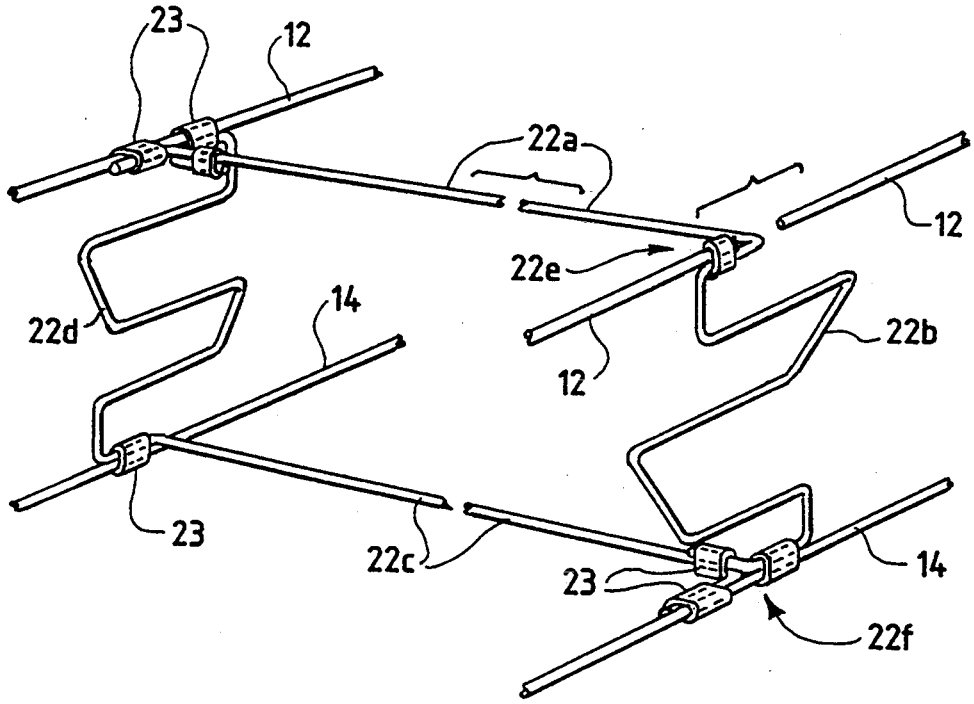
FIG. 2 is a magnified view of a portion of the edge of the innerspring unit of FIG. 1.

Turning now to FIG. 2, there is shown a magnified perspective view which more clearly illustrates the connection of the upper 12 and lower 14 border wires with the upper and lower longitudinal wires. In particular, the upper longitudinal wire 22*a* is securely affixed to the upper border wire 12 at an upper fixation point 22*e* by welding, interlocking, clipping or other means. Illustrated by way of example, the various wires are shown affixed by a number of clips 23 which securely retain the wires together. The formed wire spring segment 22*b* of the upper formed wire extends between the upper :fixation point 22*e* and a lower fixation point 22*f* where the formed wire spring segment 22*b* of the upper longitudinal formed wire 22*a* is securely affixed to the lower border wire 14 by welding, interlocking, clipping or other means. Similarly, the lower longitudinal wire 22*c* is securely affixed at the same end to the lower border wire 14 and preferably also to the end of the upper longitudinal wire as shown, by welding, interlocking, clipping or other means. In order to more securely affix the various wires together, the wires are preferably formed so as to run parallel to each other, at least for a short segment, at the fixation point. For example, the upper longitudinal wire 22*a* is formed with a right angle bend where it meets and runs parallel to the upper border wire 12, for at least a short segment, in order to more securely affix the upper longitudinal wire 22*a* to the upper border wire 12 at the upper fixation point 22*e*. Preferably, other points of fixation will also be assembled in a similar manner in order to substantially enhance the stability of the innerspring unit of the present invention.

According to an important aspect of the present invention, as can be seen from FIGS. 1 and 2, the formed wire spring segments 20*b*–28*b* of the longitudinal wires are attached directly at, and do not extend beyond, the edge between the upper 12 and lower 14 border wires. As a result, support is provided directly at the edge of the innerspring unit 10. This represents a substantial advance over conventional innerspring units which use coils, which need to be inset, and do not provide adequate support directly at the edge of the innerspring unit 10. Indeed, the support provided at the edge of the innerspring of the invention is surprisingly firmer than a conventional innerspring unit which uses coils.

Referring back to FIG. 1, there are provided a plurality of intermediate formed wire spring elements 50 which extend between and are securely affixed to the upper and lower longitudinal and lateral formed wires.

According to an important aspect of the invention, the intermediate formed wire spring elements 50 may be advantageously varied so as to provide a desired support profile for the innerspring unit 10. As illustrated, the intermediate formed wire spring elements 50 may be generally positioned so as to extend between the intersection of the upper longitudinal 20*a*–28*a* and lateral 30*a*–42*a* wires and the intersection of the lower longitudinal 20*c*–28*c* and lateral 30*c*–42*c* wires. In order to provide greater support, or "firmness," at a particular location or area, additional formed wire spring elements may be disposed between the elements positioned at the intersections. Conversely, if less support, or "softness," is desired at a particular location or area, fewer formed wire spring elements 50 may be disposed between the upper and lower longitudinal and lateral formed wires. For example, as illustrated in FIG. 1, additional formed wire spring elements 50 may be provided in the area of the innerspring unit which would generally support the torso, while other areas would only provide formed wire spring elements 50 at the intersection of the longitudinal and lateral formed wires. Thus, support at a particular location or area may be varied by essentially altering the density of the intermediate formed wire elements 50. Using this approach, a particular desired support profile may be provided for the innerspring unit 10 of the present invention.

Figure 3:
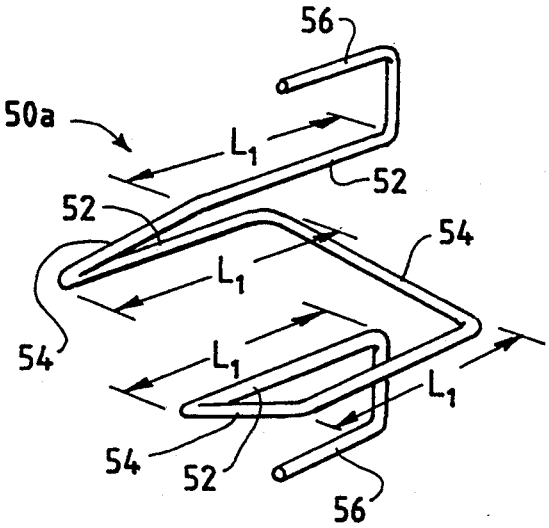
FIG. 3 illustrates a torsion bar formed wire spring element which may be used in accordance with the present invention.

According to another important aspect of the invention, there may be provided a variety of different formed wire spring elements 50. For example, some formed wire spring elements may be of a torsion bar type 50*a* while others may be of a more modular design 50*b*. As should be evident, the different types 50*a* and 50*b* of formed wire spring elements 50 will have different support characteristics. Turning now to FIG. 3, there is shown by way of example a torsion bar type formed wire spring element 50*a* that may be used to support the innerspring unit of the present invention. The formed wire spring element 50*a* will preferably be fabricated of a single piece of high carbon wire which is worked to retain bends at certain locations to provide the form desired, for example, as illustrated in FIG. 3. The torsion bar type formed wire spring element 50*a* is comprised of a plurality of generally horizontal segments 52 which perform substantially as torsion bars and a plurality of angled segments 54 that are connected therebetween. As should be evident, the generally horizontal torsion bar segments 52 resist twisting and therefore provide the primary resistive force of the spring element 50*a*. The ends 56 of the spring element 52*a* are generally horizontal in order to facilitate secure fastening to the longitudinal or lateral formed wires of the innerspring unit, as by welding, clipping, interlocking or other means. A torsion bar type formed wire spring element 50*a* as illustrated provides a significant performance advantage over conventional coils in that the torsion bar element 50*a* provides a precise and consistently reproducible response. Furthermore, the torsion bar type formed wire spring element 50*a* exhibits substantially greater resistive force and may be equivalent in resistance to many conventional coils. Therefore, using formed wire spring elements, rather than coils, to provide support substantially reduces the complexity and cost of innerspring unit of the invention.

Figure 4:
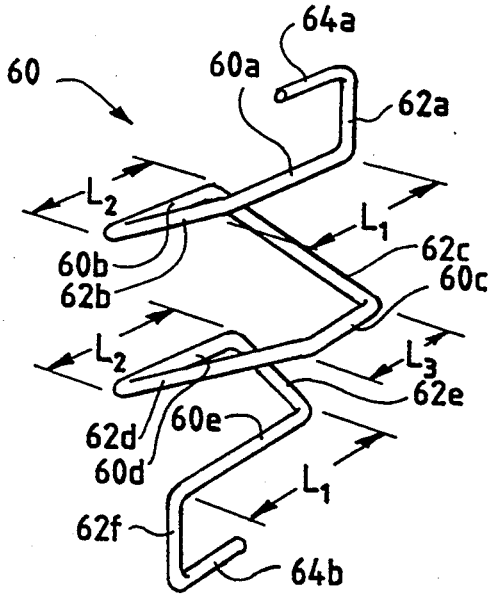
FIG. 4 illustrates another type of torsion bar formed wire spring element which may be used in accordance with the present invention.

Another significant advantage of torsion bar type formed wire spring elements 50*a* over conventional coils is that the fundamental torsion bar design may be readily and easily modified to provide a wide variety of different support characteristics. By varying the length and/or number of the horizontal torsion bar segments 52 of the formed wire spring elements 50*a* dramatically different support characteristics may be achieved. For example, reducing the length and/or number of the horizontal torsion bar segments 52 will generally result in a firmer spring element 50*a*. Conversely, increasing the length and/or number of the horizontal torsion bar segments 52 will generally result in a less firm or "softer" spring element 50*a*. In addition, certain combinations of longer and shorter torsion bar segments 52 will result in a dynamic formed wire spring element 50*a* with response or resistance characteristics which varies depending upon the load applied. As can be seen, the torsion bar segments 52 of the torsion bar formed wire spring element 50*a* illustrated in FIG. 3 are all the same length $L_1$. Illustrated by way of example in FIG. 4, however, is a dynamic formed wire spring element which has torsion bar segments of varying length. The torsion bar formed wire spring element is comprised of five different torsion bar segments 60*a*–60*e*, as well as six connecting segments 62*a*–62*f* and two attachment segments 64*a* and 64*b*. Since the outer torsion bar segments 60*a* and 60*e* are of a length $L_1$ which is notably longer than the length $L_2$ of the inner torsion bar segments 60*b* and 60*d*, the illustrated spring element will have a response characteristic which appears softer upon initial application of a load and provides greater resistance upon greater compression or application of a greater load.. As should be evident, by modifying the length and/or number of the torsion bar segments, as well as the physical configuration of the segments, an extremely wide range and different types of desirable response characteristics may be achieved.

Figure 5:
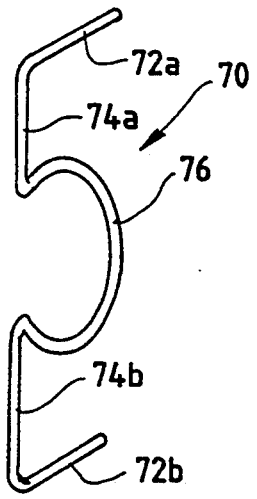
FIG. 5 illustrates a modular type formed wire spring element which may be used in accordance with the present invention.

Another type of formed wire spring element that may be used to provide support for the innerspring unit of the present invention is a modular type formed wire spring element, an example of which is illustrated in FIG. 5. The modular element 70 is comprised of two generally horizontal fixation segments 72*a* and 72*b*, two connector segments 74*a* and 74*b* and a generally semicircular spring segment 76 which provides resistance and flexibility for the element. A modular type formed wire spring element 70 as illustrated will preferably be fabricated from high carbon wire. Modification of the physical design of the modular element 70, such as, for example, providing a different gauge high carbon formed wire or changing the size and shape of the spring segment 76, can result in a wide variety of different modular type elements, each with a different and unique support characteristic. Since modular type spring elements are generally firmer than torsion bar type spring elements, it may be preferable to use modular type spring elements in areas of the innerspring unit, such as the torso area or near the edges, where greater firmness is desired. Another practical advantage of a modular type element is that it may be fabricated from a much shorter piece of high carbon wire, and therefore, is generally less expensive and adds less weight to the innerspring unit.

Figure 6:
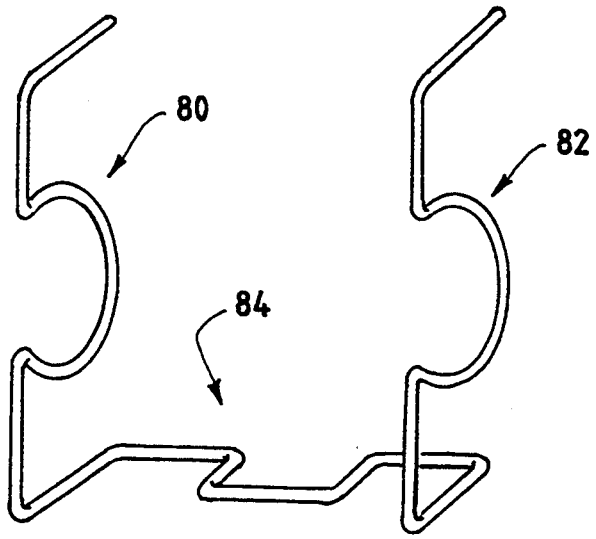
FIG. 6 illustrates a dual formed wire spring element design which may be used in accordance with the present invention.

Turning now to FIG. 6, there is illustrated an important feature of the present invention which may be used to introduce greater stability to certain areas of the innerspring unit. In particular, a pair of formed wire spring elements 80 and 82 may be advantageously fabricated from a single piece of high carbon wire and are thereby connected together by a common intermediate formed wire segment 84. The intermediate segment 84 of the dual formed wire spring element serves to enhance the stability of the innerspring unit, particularly in the direction extending from one spring segment 80 to the other 82. Thus, in areas of the innerspring unit where greater stability is desired, a number of the dual formed wire spring elements as illustrated in FIG. 6 may be used. As should be evident, dual formed wire spring elements may also be comprised of a pair of torsion bar type formed wire elements, such as those illustrated in FIG. 3 or FIG. 4, which are connected together in a similar manner with a common intermediate formed wire segment.

Figure 7:
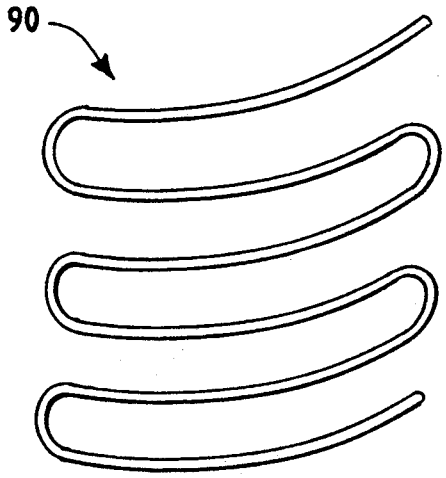
FIG. 7 illustrates another formed wire spring element which may be used to provide support at the comer of the innerspring unit of the present invention.

Illustrated by way of example in FIG. 7 is a formed wire spring element that may be used to provide support in the corners of the innerspring unit of the present invention. As illustrated the corner spring element 90 has a generally serpentine configuration and is curved so as to conform rather closely to the shape of the comer of the innerspring unit. Similar to the formed wire spring elements that are disposed on the edge of the innerspring unit the corner spring element provides support that extends directly between the upper 12 and lower 14 border wires at the corner. Thus, the illustrated corner wire spring element 90 represents a substantial advance over conventional innerspring units that use coils which must be inset, and therefore, do not provide support directly at the corner of the innerspring unit 10.

Figure 8:
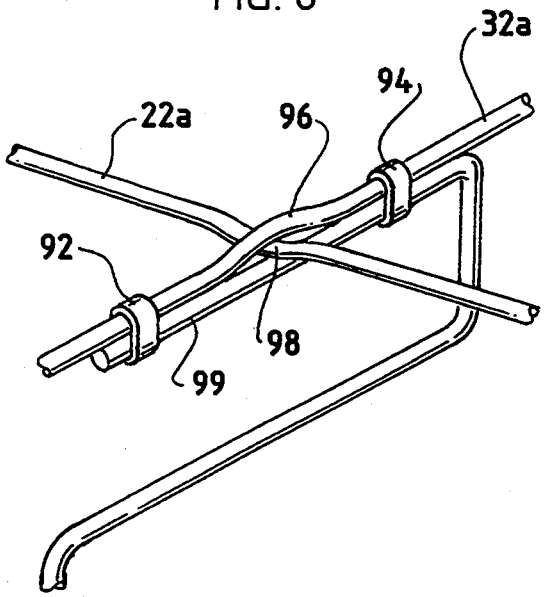
FIG. 8 is a magnified view of a portion of the innerspring unit of FIG. 1 which depicts a preferred connection of longitudinal and lateral formed wires.

In order to substantially enhance stability, the longitudinal and lateral formed wires are preferably provided with complimentary recesses at points of intersection. A magnified view of one such point of intersection is illustrated more clearly by way of example in FIG. 8 in conjunction with the intersection of an upper longitudinal formed wire 22*a* and an upper lateral formed wire 32*a*. As can be seen, at the particular intersection point illustrated, the lateral formed wire 32*a* is disposed in the upper position at the intersection and one end of a formed wire spring element is also attached to the lateral forerod wire 32*a* by a pair of clips 92 and 94. At the point of intersection, the lateral formed wire 32*a* has an upward extending recess 96 and the longitudinal formed wire 22*a* has a complimentary downward extending recess 98. At the intersection, a pair of clips 92 and 94, one 92 positioned on one side of the point of intersection and the other 94 on the other side, securely correct the formed wire spring element to the lateral formed wire 32*a* and also bring the complimentary recesses 96, 98 into secure contact. As can be seen, the clips 92 and 94 also securely affix the associated formed wire spring element 99 at the intersection. The complimentary recesses 96, 98 introduce significant stability at the points of intersection by precluding undesirable movement of the longitudinal 22*a* and lateral wires 32*a* with respect to each other.

As should be evident, either the longitudinal 22*a* or the lateral 32*a* formed wire may be disposed in the upper position at the point of intersection. It may be preferable, however, to alternate which wires assume the upper and lower positions at the various points of intersection. For example, in some designs even greater stability may be achieved if the longitudinal wire is disposed as the upper wire with respect to the lateral wire at one intersection while the longitudinal wire is disposed as the lower wire with respect to the lateral wire at an adjacent intersection. In such a configuration, the longitudinal and lateral wires are essentially woven together and may provide substantially greater stability for the innerspring unit.

Figure 9:
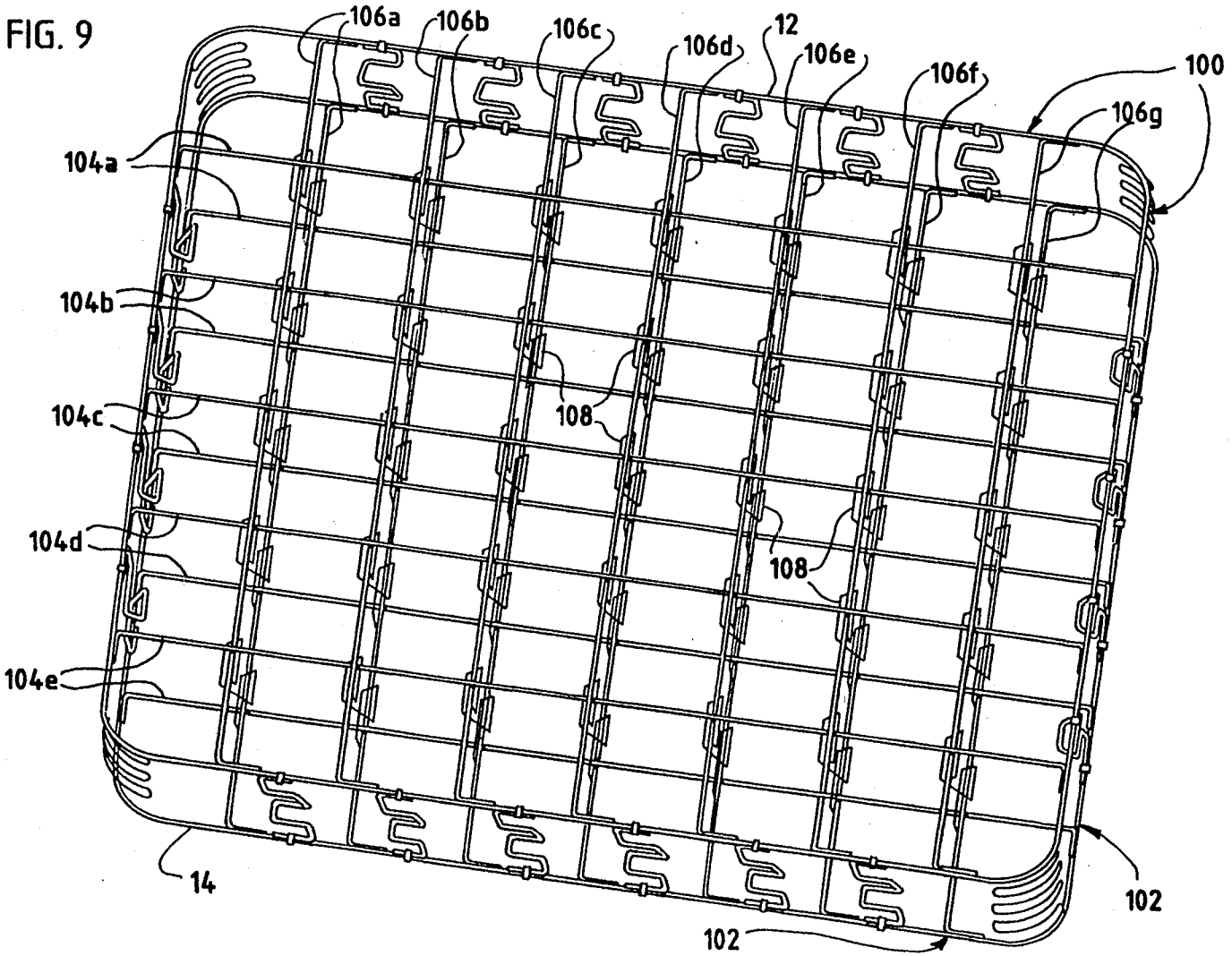
FIG. 9 is a perspective view of an innerspring unit according to another embodiment of the present invention.

Turning now to FIG. 9 there is illustrated another embodiment of the innerspring unit of the present invention. This embodiment is comprised of an upper and lower deck 100 and 102, each of which is formed from a crisscross matrix of low carbon wire extending between the upper and lower border wires 12 and 14. According to an important aspect of this embodiment of the invention, the upper and lower decks may be preformed, for example, by an automated mass production process. A plurality of longitudinal wires 104*a*–104*e*, which extend from the border wire on one side to the border wire on the other side, may be securely fastened to the border wire by welding, interlocking, clipping or other means. Similarly, a plurality of lateral wires 106*a*–106*g* extend orthogonal to the longitudinal wires 104*a*–104*e* and are securely fastened to the border wire on one side and the border wire on the other side.

A plurality of formed wire spring elements 108 provide support and are disposed between the upper 100 and lower 102 wire decks. By using a combination and variety of different formed wire spring elements, such as those illustrated and described in connection with FIGS. 3–7, an innerspring unit with wire decks may be provided with any variety of different desired support profiles. For example, relatively firmer modular type formed wire elements may be disposed in the torso area of the innerspring unit, while less firm or softer elements may be disposed in other areas. Formed wire spring elements similar to those formed at the ends of the longitudinal and lateral wires as illustrated in FIG. 2 (without the longitudinal and lateral wires) may be provided at the edges between the upper and lower border wires. Similarly, corner formed wire spring elements may be provided to support the innerspring unit between the upper and lower border wires at the corners. In addition, dual formed wire spring elements as illustrated in FIG. 6 may be used in areas of the innerspring unit where additional stability may be desired.

It can be seen from the foregoing detailed description that by varying the type, design, location and density of the formed wire spring elements, a nearly infinite variety of different support profiles may be produced in accordance with the innerspring unit of the present invention. For example, an innerspring unit may be produced where one-half is generally much firmer than the other half in order to accommodate two individuals where one individual has much greater weight than the other. Similarly, by using firmer formed wire spring elements in the torso area and softer formed wire spring elements in other areas a particularly desirable support profile may be provided in accordance with the invention. According to another important aspect of the invention, enhanced stability of the innerspring unit may be produced by using a dual formed wire spring element and by advantageously providing complimentary interlocking recesses at the intersection of the longitudinal and lateral wires.

What is claimed is:

1. An improved innerspring unit, comprising:

a plurality of generally parallel and planar upper longitudinal formed wires;

a plurality of generally parallel and planar upper lateral formed wires disposed generally orthogonal to, and which intersect, said plurality of upper longitudinal formed wires;

a plurality of generally parallel and planar lower longitudinal formed wires;

a plurality of generally parallel and planar lower lateral formed wires disposed generally orthogonal of and which intersect said plurality of lower longitudinal formed wires;

a plurality of formed wire spring elements extending between said plurality of upper longitudinal and lateral formed wires and said plurality of lower longitudinal and lateral formed wires, wherein at least one of said plurality of formed wire spring elements is a torsion bar type formed wire spring element comprised of a plurality of torsion bar segments that vary in length.

2. An improved innerspring unit comprising:

an upper border wire which is generally rectangular in shape and defines an upper plane having two opposing longitudinal sides and two opposing lateral sides;

a lower border wire which is generally rectangular in shape and defines a lower plane having two opposing longitudinal sides and two opposing lateral sides;

a plurality of generally parallel upper longitudinal formed wires extending between one lateral side and the other lateral side of said upper border wire and a plurality of generally parallel upper lateral formed wires extending between one longitudinal side and the other longitudinal side of said upper border wire, each of which intersects with said plurality of upper longitudinal formed wires at a plurality of upper intersection points, wherein at substantially all of said plurality of upper intersection points said plurality of upper longitudinal formed wires and said plurality of upper lateral formed wires are provided with complimentary interlocking recesses;

a plurality of generally parallel lower longitudinal formed wires extending between one lateral side and the other lateral side of said lower border wire and a plurality of generally parallel lower lateral formed wires extending between one longitudinal side and the other longitudinal side of said lower border wire, each of said plurality of upper lateral formed wires intersects with said plurality of lower longitudinal formed wires at a plurality of lower intersection points, wherein at substantially all of said plurality of lower intersection points said plurality of lower longitudinal foraged wires and said plurality of lower lateral formed wires are provided with complimentary interlocking recesses; and a plurality of formed wire spring elements connected between said upper longitudinal and lateral formed wires and said lower longitudinal and lateral formed wires, wherein at least one of said formed wire spring elements has (i) a first end segment disposed substantially in said upper plane and extending across an upper intersection point and substantially parallel and adjacent to one of said wires forming said upper intersection point and wherein said first end segment is securely fastened to said parallel and adjacent wire on one side of said upper intersection point and is securely fastened to said parallel and adjacent wire on the other side of said upper intersection point, and (ii) a second end segment disposed substantially in said lower plane and extending across a lower intersection pointand substantially parallel and adjacent to one of said wires forming said lower intersection point and wherein said second end segment is securely fastened to said parallel and adjacent wire on one side of said lower intersection point and is securely fastened to said parallel and adjacent wire on the other side of said lower intersection point.

3. The improved innerspring unit of claim 2 further comprising a plurality of formed wire spring elements connected between said upper and said lower border wires.

4. The improved innerspring unit of claim 2 where said innerspring unit has a predetermined support profile comprised of at least one firmer region where there is disposed a first set of said plurality of formed wire spring elements and a softer region where there is disposed a second set of said plurality of formed wire spring elements.

5. The improved innerspring unit of claim 4 wherein the formed wire spring elements of said first set are more densely disposed in said firmer region than the formed wire spring elements of said second set in said softer region.

6. The improved innerspring unit of claim 4 wherein the formed wire spring elements of said first set are generally firmer than the formed wire spring elements of said second set.

7. The improved innerspring unit of claim 2 wherein said upper longitudinal formed wires include at least one formed wire spring segment extending from one lateral side of said upper border wire to the corresponding lateral side of said lower border wire, and wherein said upper lateral formed wires include at least one formed wire spring segment extending from one longitudinal side of said upper border wire to the corresponding longitudinal side of said lower border wire.

8. The improved innerspring unit of claim 2 wherein said lower longitudinal formed wires include at least one formed wire spring segment extending from one lateral side of said lower border wire to the corresponding lateral side of said upper border wire, and wherein said lower lateral formed wires include at least one formed wire spring segment extending from one longitudinal side of said lower border wire to the corresponding longitudinal side of said upper border wire.

9. An improved innerspring unit, comprising:

a plurality of generally parallel and planar upper longitudinal formed wires;

a plurality of generally parallel and planar upper lateral formed wires disposed generally orthogonal to, and which intersect, said plurality of upper longitudinal formed wires;

a plurality of generally parallel and planar lower longitudinal formed wires;

a plurality of generally parallel and planar lower lateral formed wires disposed generally orthogonal of and which intersect said plurality of lower longitudinal formed wires;

a plurality of formed wire spring elements extending between said plurality of upper longitudinal and lateral formed wires and said plurality of lower longitudinal and lateral formed wires, wherein at least one of said plurality of formed wire spring elements is a modular type formed wire spring element.

10. An improved innerspring unit, comprising:

a plurality of generally parallel and planar upper longitudinal formed wires;

a plurality of generally parallel and planar upper lateral formed wires disposed generally orthogonal to, and which intersect, said plurality of upper longitudinal formed wires;

a plurality of generally parallel and planar lower longitudinal formed wires;

a plurality of generally parallel and planar lower lateral formed wires disposed generally orthogonal of and which intersect said plurality of lower longitudinal formed wires;

a plurality of formed wire spring elements extending between said plurality of upper longitudinal and lateral formed wires and said plurality of lower longitudinal and lateral formed wires, wherein at least one of said plurality of formed wire spring elements is a corner type formed wire spring element comprised of a formed wire in a generally serpentine configuration and which is curved so as to conform to a corner of said innerspring unit.

11. An improved innerspring unit comprising:

an upper border wire which is generally rectangular in shape and defines an upper plane having two opposing longitudinal sides and two opposing lateral sides;

a lower border wire which is generally rectangular in shape and defines a lower plane having two opposing longitudinal sides and two opposing lateral sides;

a plurality of generally parallel upper longitudinal formed wires extending between one lateral side and the other lateral side of said upper border wire and a plurality of generally parallel upper lateral formed wires extending between one longitudinal side and the other longitudinal side of said upper border wire, each of intersects with said plurality of upper longitudinal formed wires at a plurality of upper intersection points, wherein at substantially all of said plurality of upper intersection points said plurality of upper longitudinal formed wires and said plurality of upper lateral formed wires are provided with complimentary interlocking recesses;

a plurality of generally parallel lower longitudinal formed wires extending between one lateral side and the other lateral side of said lower border wire and a plurality of generally parallel lower lateral formed wires extending between one longitudinal side and the other longitudinal side of said lower border wire, each of said plurality of upper lateral formed wires intersects with said plurality of lower longitudinal formed wires at a plurality of lower intersection points, wherein at substantially all of said plurality of lower intersection points said plurality of lower longitudinal formed wires and said plurality of lower lateral formed wires are provided with complimentary interlocking recesses; and a plurality of formed wire spring elements connected between said upper longitudinal and lateral formed wires and said lower longitudinal and lateral formed wires, wherein said innerspring unit has a predetermined support profile comprised of at least one firmer region where there is disposed a first set of said plurality of formed wire spring elements and a softer region where there is disposed a second set of said plurality of formed wire spring elements, wherein the formed wire spring elements of said first set are more densely disposed in said firmer region than the formed wire spring elements of said second set in said softer region.

12. An improved innerspring unit comprising:

an upper border wire which is generally rectangular in shape and defines an upper plane having two opposing longitudinal sides and two opposing lateral sides;

a lower border wire which is generally rectangular in shape and defines a lower plane having two opposing longitudinal sides and two opposing lateral sides;

a plurality of generally parallel upper longitudinal formed wires extending between one lateral side and the other lateral side of said upper border wire and a plurality of generally parallel upper lateral formed wires extending between one longitudinal side and the other longitudinal side of said upper border wire, each of intersects with said plurality of upper longitudinal formed wires at a plurality of upper intersection points, wherein at substantially all of said plurality of upper intersection points said plurality of upper longitudinal formed wires and said plurality of upper lateral formed wires are provided with complimentary interlocking recesses;

a plurality of generally parallel lower longitudinal formed wires extending between one lateral side and the other lateral side of said lower border wire and a plurality of generally parallel lower lateral formed wires extending between one longitudinal side and the other longitudinal side of said lower border wire, each of said plurality of upper lateral formed wires intersects with said plurality of lower longitudinal formed wires at a plurality of lower intersection points, wherein at substantially all of said plurality of lower intersection points said plurality of lower longitudinal formed wires and said plurality of lower lateral formed wires are provided with complimentary interlocking recesses; and a plurality of formed wire spring elements connected between said upper longitudinal and lateral formed wires and said lower longitudinal and lateral formed wires, wherein at least one of said plurality of formed wire spring elements is a torsion bar type formed wire spring element comprised of a plurality of torsion bar segments that vary in length.

13. An improved innerspring unit comprising:

an upper border wire which is generally rectangular in shape and defines an upper plane having two opposing longitudinal sides and two opposing lateral sides;

a lower border wire which is generally rectangular in shape and defines a lower plane having two opposing longitudinal sides and two opposing lateral sides;

a plurality of generally parallel upper longitudinal formed wires extending between one lateral side and the other lateral side of said upper border wire and a plurality of generally parallel upper lateral formed wires extending between one longitudinal side and the other longitudinal side of said upper border wire, each of intersects with said plurality of upper longitudinal formed wires at a plurality of upper intersection points, wherein at substantially all of said plurality of upper intersection points said plurality of upper longitudinal formed wires and said plurality of upper lateral formed wires are provided with complimentary interlocking recesses;

a plurality of generally parallel lower longitudinal formed wires extending between one lateral side and the other lateral side of said lower border wire and a plurality of generally parallel lower lateral formed wires extending between one longitudinal side and the other longitudinal side of said lower border wire, each of said plurality of upper lateral formed wires intersects with said plurality of lower longitudinal formed wires at a plurality of lower intersection points, wherein at substantially all of said plurality of lower intersection points said plurality of lower longitudinal formed wires and said plurality of lower lateral formed wires are provided with complimentary interlocking recesses; and a plurality of formed wire spring elements connected between said upper longitudinal and lateral formed wires and said lower longitudinal and lateral formed wires, wherein at least one of said plurality of formed wire spring elements is a modular type formed wire spring element.

14. An improved innerspring unit comprising:

an upper border wire which is generally rectangular in shape and defines an upper plane having two opposing longitudinal sides and two opposing lateral sides;

a lower border wire which is generally rectangular in shape and defines a lower plane having two opposing longitudinal sides and two opposing lateral sides;

a plurality of generally parallel upper longitudinal formed wires extending between one lateral side and the other lateral side of said upper border wire and a plurality of generally parallel upper lateral formed wires extending between one longitudinal side and the other longitudinal side of said upper border wire, each of intersects with said plurality of upper longitudinal formed wires at a plurality of upper intersection points, wherein at substantially all of said plurality of upper intersection points said plurality of upper longitudinal framed wires and said plurality of upper lateral formed wires are provided with complimentary interlocking recesses;

a plurality of generally parallel lower longitudinal formed wires extending between one lateral side and the other lateral side of said lower border wire and a plurality of generally parallel lower lateral formed wires extending between one longitudinal side and the other longitudinal side of said lower border wire, each of said plurality of upper lateral formed wires intersects with said plurality of lower longitudinal formed wires at a plurality of lower intersection points, wherein at substantially all of said plurality of lower intersection points said plurality of lower longitudinal formed wires and said plurality of lower lateral formed wires are provided with complimentary interlocking recesses; and a plurality of formed wire spring elements connected between said upper longitudinal and lateral formed wires and said lower longitudinal and lateral formed wires, wherein at least one of said plurality of formed wire spring elements is a corner type formed wire spring element comprised of a formed wire in a generally serpentine configuration and which is curved so as to conform to a corner of said innerspring unit.

15. An improved innerspring unit, comprising:

a plurality of generally parallel and planar upper longitudinal formed wires;

a plurality of generally parallel and planar upper lateral formed wires disposed generally orthogonal to, and which intersect, said plurality of upper longitudinal formed wires;

a plurality of generally parallel and planar lower longitudinal formed wires;

a plurality of generally parallel and planar lower lateral formed wires disposed generally orthogonal of and which intersect said plurality of lower longitudinal formed wires;

a plurality of formed wire spring elements extending between said plurality of upper longitudinal and lateral formed wires and said plurality of lower longitudinal and lateral formed wires, wherein said innerspring unit has a predetermined support profile comprised of at least one firmer region where there is disposed a first set of said plurality of formed wire spring elements and a softer region where there is disposed a second set of said plurality of formed wire spring elements, wherein the formed wire spring elements of said first set are more densely disposed in said firmer region than the formed wire spring elements of said second set in said softer region.

16. An improved innerspring unit, comprising:

a plurality of generally parallel and planar upper longitudinal formed wires;

a plurality of generally parallel and planar upper lateral formed wires disposed generally orthogonal to, and which intersect, said plurality of upper longitudinal formed wires;

a plurality of generally parallel and planar lower longitudinal formed wires;

a plurality of generally parallel and planar lower lateral formed wires disposed generally orthogonal of and which intersect said plurality of lower longitudinal formed wires;

a plurality of formed wire spring elements extending between said plurality of upper longitudinal and lateral formed wires and said plurality of lower longitudinal and lateral formed wires, wherein said innerspring unit has a predetermined support profile comprised of at least a first region having a first support profile and a second region having a second support profile different from said first support profile, wherein said first region includes a torsion bar type formed wire spring element comprised of a plurality of torsion bar segments that vary in length.

17. An improved innerspring unit comprising:

an upper border wire which is generally rectangular in shape and defines an upper plane having two opposing longitudinal sides and two opposing lateral sides;

a lower border wire which is generally rectangular in shape and defines a lower plane having two opposing longitudinal sides and two opposing lateral sides;

a plurality of generally parallel upper longitudinal formed wires extending between one lateral side and the other lateral side of said upper border wire and a plurality of generally parallel upper lateral formed wires extending between one longitudinal side and the other longitudinal side of said upper border wire, each of intersects with said plurality of upper longitudinal formed wires at a plurality of upper intersection points, wherein at substantially all of said plurality of upper intersection points said plurality of upper longitudinal formed wires and said plurality of upper lateral formed wires are provided with complimentary interlocking recesses;

a plurality of generally parallel lower longitudinal formed wires extending between one lateral side and the other lateral side of said lower border wire and a plurality of generally parallel lower lateral formed wires extending between one longitudinal side and the other longitudinal side of said lower border wire, each of said plurality of upper lateral formed wires intersects with said plurality of lower longitudinal formed wires at a plurality of lower intersection points, wherein at substantially all of said plurality of lower intersection points said plurality of lower longitudinal formed wires and said plurality of lower lateral formed wires are provided with complimentary interlocking recesses; and a plurality of formed wire spring elements connected between said upper longitudinal and lateral formed wires and said lower longitudinal and lateral formed wires, wherein said innerspring unit has a predetermined support profile comprised of at least a first region having a first support profile and a second region having a second support profile different from said first support profile, wherein said first region includes a torsion bar type formed wire spring element comprised of a plurality of torsion bar segments that vary in length.

18. An improved innerspring unit, comprising:

a plurality of generally parallel and planar upper longitudinal formed wires;

a plurality of generally parallel and planar upper lateral formed wires disposed generally orthogonal to, and which intersect, said plurality of upper longitudinal formed wires;

a plurality of generally parallel and planar lower longitudinal formed wires;

a plurality of generally parallel and planar lower lateral formed wires disposed generally orthogonal of and which intersect said plurality of lower longitudinal formed wires;

a plurality of formed wire spring elements extending between said plurality of upper longitudinal and lateral formed wires and said plurality of lower longitudinal and lateral formed wires, wherein at least one of said plurality of formed wire spring elements is a dual type formed wire spring element formed from a continuous length of wire having a first formed wire spring segment, a second formed wire spring segment and an intermediate formed wire segment connected between said first and said second formed wire spring segments.

19. An improved innerspring unit comprising:

an upper border wire which is generally rectangular in shape and defines an upper plane having two opposing longitudinal sides and two opposing lateral sides;

a lower border wire which is generally rectangular in shape and defines a lower plane having two opposing longitudinal sides and two opposing lateral sides;

a plurality of generally parallel upper longitudinal formed wires extending between one lateral side and the other lateral side of said upper border wire and a plurality of generally parallel upper lateral formed wires extending between one longitudinal side and the other longitudinal side of said upper border wire, each of intersects with said plurality of upper longitudinal formed wires at a plurality of upper intersection points, wherein at substantially all of said plurality of upper intersection points said plurality of upper longitudinal formed wires and said plurality of upper lateral formed wires are provided with complimentary interlocking recesses;

a plurality of generally parallel lower longitudinal formed wires extending between one lateral side and the other lateral side of said lower border wire and a plurality of generally parallel lower lateral formed wires extending between one longitudinal side and the other longitudinal side of said lower border wire, each of said plurality of upper lateral formed wires intersects with said plurality of lower longitudinal formed wires at a plurality of lower intersection points, wherein at substantially all of said plurality of lower intersection points said plurality of lower longitudinal formed wires and said plurality of lower lateral formed wires are provided with complimentary interlocking recesses; and a plurality of formed wire spring elements connected between said upper longitudinal and lateral formed wires and said lower longitudinal and lateral formed wires, wherein at least one of said plurality of formed wire spring elements is a dual type formed wire spring element formed from a continuous length of wire having a first formed wire spring segment, a second formed wire spring segment and an intermediate formed wire segment connected between said first and said second formed wire spring segments.

20. An improved innerspring unit comprising:

an upper border wire disposed in a generally rectangular shape having four sides that define an upper plane;

a lower border wire disposed in a generally rectangular shape having four sides that define a lower plane;

an upper support deck disposed substantially in said upper plane comprised of an array of upper support wires extending between and connected to at least two sides of said upper border wire;

a lower support deck disposed substantially in said lower plane comprised of an array of lower support wires extending between and connected to at least two sides of said lower border wire;

a plurality of formed wire spring elements connected between said upper support deck and said lower support deck, wherein said plurality of formed wire spring elements includes a dual type formed wire spring element formed from a continuous length of wire having a first formed wire spring segment, a second formed wire spring segment and an intermediate formed wire segment connected between said first and said second formed wire spring segments.

21. An improved innerspring unit comprising:

an upper border wire disposed in a generally rectangular shape having four sides that define an upper plane;

a lower border wire disposed in a generally rectangular shape having four sides that define a lower plane;

an upper support deck disposed substantially in said upper plane comprised of an array of upper support wires extending between and connected to at least two sides of said upper border wire;

a lower support deck disposed substantially in said lower plane comprised of an array of lower support wires extending between and connected to at least two sides of said lower border wire;

a plurality of formed wire spring elements connected between said upper support deck and said lower support deck, wherein said plurality of formed wire spring elements includes a torsion bar type formed wire spring element comprised of a plurality of torsion bar segments that vary in length.

* * * * *